US008579638B2

(12) United States Patent
Schaarschmidt et al.

(10) Patent No.: US 8,579,638 B2
(45) Date of Patent: Nov. 12, 2013

(54) PRESSFIT CONTACT FOR CONNECTING AN ELECTRONIC COMPONENT TO A CIRCUIT BOARD AND PRESSFIT TOOL AND METHOD FOR PRODUCING A PRESSFIT CONTACT

(75) Inventors: Matthias Schaarschmidt, Limbach-Oberfrohna (DE); Richard Bayer, Greding (DE); Michael Juergens, Woelfersheim (DE)

(73) Assignees: USK Karl Utz Sondermaschinen GmbH, Limbach-Oberfrohna (DE); Continental Teves AG & Co. OHG, Frankfurt/Main (DE); Conti Temic Microelectronic GmbH, Nuremberg (DE)

( * ) Notice: Subject to any disclaimer, the term of this patent is extended or adjusted under 35 U.S.C. 154(b) by 7 days.

(21) Appl. No.: 13/377,504

(22) PCT Filed: Jun. 9, 2010

(86) PCT No.: PCT/DE2010/075048

§ 371 (c)(1),
(2), (4) Date: Jan. 6, 2012

(87) PCT Pub. No.: WO2010/142289

PCT Pub. Date: Dec. 16, 2010

(65) Prior Publication Data

US 2012/0115339 A1 May 10, 2012

(30) Foreign Application Priority Data

Jun. 11, 2009 (DE) ..... 10 2009 025 113

(51) Int. Cl.
*H01R 12/00* (2006.01)

(52) U.S. Cl.
USPC ..... 439/82

(58) Field of Classification Search
USPC ..... 439/82, 567; 29/747, 760
See application file for complete search history.

(56) References Cited

U.S. PATENT DOCUMENTS 4,676,579 A * 6/1987 Ting ..... 439/825
4,753,602 A * 6/1988 Peyrat et al. ..... 439/78

(Continued)

FOREIGN PATENT DOCUMENTS

DE 87 14 341 U1 4/1988
DE 103 03 009 A1 8/2004

(Continued)

OTHER PUBLICATIONS

English-language translation of the International Preliminary Report on Patentability (Eight (8) pages).

(Continued)

*Primary Examiner* — Ross Gushi
(74) *Attorney, Agent, or Firm* — Crowell & Moring LLP

(57) ABSTRACT

A press-in contact and a press-in tool for connecting an electronic component to a printed circuit board, the press-in contact of the electronic component being pressed into a contact opening of the printed circuit board by the press-in tool. Also a method for producing a press-in contact. The press-in contact includes at least one guide region which can be received in a guide contour of the press-in tool in a position-fixing manner. The maximum length of the guide region is a multiple of the maximum width or is substantially equal to or only slightly shorter than the maximum width and/or the guide region is highly rigid in the press-in direction (z direction) and flexible in the other directions (x/y directions). The method according to the invention is characterized in that contiguous, interlinked contours of the press-in contacts, which contours are produced as a ribbon or band, are supplied to a separating station and are separated at predetermined separation points into individual press-in contacts.

29 Claims, 6 Drawing Sheets

(56) References Cited

U.S. PATENT DOCUMENTS

| | | | | |
|---|---|---|---|---|
| 5,320,549 | A * | 6/1994 | Schempp et al. | 439/246 |
| 5,564,954 | A * | 10/1996 | Wurster | 439/751 |
| 5,575,666 | A * | 11/1996 | Dent | 439/82 |
| 6,071,152 | A * | 6/2000 | Achammer et al. | 439/733.1 |
| 6,083,060 | A * | 7/2000 | Chen et al. | 439/885 |
| 6,139,377 | A * | 10/2000 | Chen | 439/885 |
| 6,186,843 | B1 * | 2/2001 | Chen et al. | 439/885 |
| 6,190,214 | B1 * | 2/2001 | Bianca et al. | 439/751 |
| 6,196,886 | B1 * | 3/2001 | Sato | 439/885 |
| 6,206,735 | B1 * | 3/2001 | Zanolli | 439/736 |
| 6,315,581 | B1 | 11/2001 | Yu | |
| 6,592,382 | B2 * | 7/2003 | Wurster | 439/82 |
| 6,623,280 | B2 * | 9/2003 | Oldenburg et al. | 439/75 |
| 6,685,484 | B2 * | 2/2004 | Keyser | 439/77 |
| 6,866,523 | B2 * | 3/2005 | Yamashita | 439/79 |
| 6,875,032 | B2 * | 4/2005 | Tsuchiya | 439/82 |
| 7,017,259 | B2 * | 3/2006 | Aoki | 29/739 |
| 7,037,146 | B2 * | 5/2006 | Nakamura | 439/751 |
| 7,044,805 | B1 * | 5/2006 | Huang | 439/676 |
| 7,048,594 | B2 * | 5/2006 | Tsuchiya | 439/751 |
| 7,048,595 | B2 * | 5/2006 | Nakamura et al. | 439/751 |
| 7,083,431 | B1 * | 8/2006 | Darr et al. | 439/75 |
| 7,104,811 | B2 * | 9/2006 | Sakata et al. | 439/79 |
| 7,361,031 | B2 * | 4/2008 | Matsumura | 439/82 |
| 7,377,823 | B2 * | 5/2008 | Chen | 439/751 |
| 7,445,499 | B2 * | 11/2008 | Nunokawa et al. | 439/567 |
| 7,488,219 | B2 * | 2/2009 | Matsumura | 439/751 |
| 7,621,788 | B1 * | 11/2009 | Feng | 439/885 |
| 7,722,413 | B2 * | 5/2010 | Tonosaki | 439/751 |
| 8,317,525 | B2 * | 11/2012 | Bayerer | 439/75 |
| 2001/0047583 | A1 * | 12/2001 | Van Den Aker | 29/747 |
| 2002/0115316 | A1 * | 8/2002 | Bright | 439/82 |
| 2003/0082931 | A1 * | 5/2003 | Keyser | 439/66 |
| 2003/0092296 | A1 * | 5/2003 | Oldenburg et al. | 439/75 |
| 2003/0114027 | A1 * | 6/2003 | Wurster | 439/82 |
| 2003/0236009 | A1 * | 12/2003 | Tsuchiya | 439/82 |
| 2004/0192086 | A1 * | 9/2004 | Aoki | 439/82 |
| 2005/0003704 | A1 * | 1/2005 | Kasahara | 439/567 |
| 2005/0037644 | A1 * | 2/2005 | Ravert et al. | 439/82 |
| 2005/0070139 | A1 * | 3/2005 | Kaneko et al. | 439/82 |
| 2005/0250356 | A1 * | 11/2005 | Matsumura et al. | 439/82 |
| 2005/0277312 | A1 * | 12/2005 | Nakamura | 439/82 |
| 2006/0264076 | A1 * | 11/2006 | Chen | 439/82 |
| 2007/0077813 | A1 * | 4/2007 | Matsumura | 439/578 |
| 2007/0099448 | A1 | 5/2007 | Taylor et al. | |
| 2007/0270001 | A1 * | 11/2007 | Matsumura | 439/82 |
| 2008/0050946 | A1 * | 2/2008 | Nunokawa et al. | 439/82 |
| 2008/0050947 | A1 * | 2/2008 | Nunokawa et al. | 439/82 |
| 2008/0119093 | A1 | 5/2008 | Bleicher et al. | |
| 2008/0182460 | A1 | 7/2008 | Fedder et al. | |

FOREIGN PATENT DOCUMENTS

| | | | |
|---|---|---|---|
| DE | 10 2006 055 086 | B3 | 6/2008 |
| DE | 20 2008 012 657 | U1 | 4/2010 |
| EP | 1 562 262 | A2 | 8/2005 |
| WO | WO 95/14315 | A1 | 5/1995 |
| WO | WO 2004/068921 | A2 | 8/2004 |
| WO | WO 2007/093140 | A1 | 8/2007 |

OTHER PUBLICATIONS

International Search Report with English translation dated Feb. 7, 2011 (six (6) pages).

* cited by examiner

PRESSFIT CONTACT FOR CONNECTING AN ELECTRONIC COMPONENT TO A CIRCUIT BOARD AND PRESSFIT TOOL AND METHOD FOR PRODUCING A PRESSFIT CONTACT

The invention relates to a pressfit contact in a pressfit tool for connecting an electronic component to a circuit board, the pressfit contact of the electronic component being able to be pressfit by the pressfit tool into a contact opening of the circuit board, and a method for producing a pressfit contact.

Manifold solutions are known from the prior art, which relate to the implementation and installation of pressfit pins, which are used in plug connectors. For the tools used during the installation of such pressfit pins, blade plugs, or pins for plug connectors or power strips, there is typically sufficient space provided to ensure proper press fitting into a circuit board, for example.

Thus, for example, pin-like blade plugs for plug connectors are described in DE 87 14 341 U1, which are arranged on a circuit board in multiple rows in a specific grid dimension to one another. In order to ensure a solid seat of the blade plugs in the circuit board, each blade plug is implemented having a corresponding pressfit zone. The fastening of the blade plugs in the circuit board is performed by means of a pressfit tool, using which multiple blade plugs are pressfit into the openings of the circuit board. In order to avoid a skewed pressfit and a deformation of the plugs, the blade plug is provided above its pressfit zone with stop shoulders protruding laterally beyond the pin, on which the pressfit tool can engage.

The pressfit pin which is described in DE 10 2006 055 086 B3 is also used for electrical contacts in particular in plug connectors. The pressfit pin is to be implemented here so that it can be pressfit without damaging it. For this purpose, the pressfit pin has a shoulder element, with the aid of which a tool can grasp the pin and can transmit a force thereto in the longitudinal direction of the pin. The shoulder element can have different designs.

In order to avoid displacements or deformations of the components during the installation of electronic components on circuit boards, precise positioning of the pressfit contacts or pressfit pins to the contact openings of the circuit board is required. For correspondingly large dimensioned electronic components, special pressfit tools must be used, which occupy as little installation space as possible. Such pressfit tools, such as installation combs, accommodate the pressfit contacts or pressfit pins and perform corresponding positioning.

An electronic component to be arranged on a circuit board is disclosed in DE 103 03 009 A1. This component has terminal wires having pressfit contacts and is thus to be electrically connected to contact openings solely by press fitting the pressfit contacts, without additional adapters. The pressfit contacts are provided with a shoulder to transmit the pressfit force and limit the pressfit depth in the contact opening. The pressfit contact is inserted and pressfit into the contact opening with the aid of a tool.

DE 103 03 009 A1 does not discuss the pressfit tool or the existing installation space in greater detail. However, it is easily conceivable that precise positioning of the pressfit contacts to the circuit board openings and a linear pressfit along the axis of the pressfit contact are not ensured. Skewing of the pressfit contact can easily occur, whereby proper fastening of the electronic components is not possible.

Installation (in particular concealed) of press contacts, in contrast, requires precise positioning of the press contact tips to the circuit board openings during the joining movement. For this purpose, installation combs, which are very complex or are driven by complex technology, are currently used, which require a relatively large installation space.

Thus, in DE 20 2008 012 657.6 (no prior publication), a tool for producing a contact of an electronic component with a circuit board is described, in which the tool, which is implemented as an installation comb, has a sleeve-shaped guide body, which receives an axially movable sliding part. There is a relative mobility in the axial direction between the sliding part and the guide body. The pressfit contacts are accommodated in grooves of the guide body or the sliding part which are used as positioning aids. The pressfit contacts each have a shoulder, using which they press against a stop of the guide body (or the sliding part) during the press fitting procedure.

Installation using the described installation comb can only be implemented with difficulty due to the ever more cramped construction of the electronic assemblies.

The object of the invention comprises providing a pressfit contact and a pressfit tool for connecting an electronic component to a circuit board, and a simple method for producing a pressfit contact, easy fastening of the electronic component on the circuit board being ensured with high positioning precision employing a cost-effective pressfit tool even in a small installation space.

This object is achieved according to the invention by the features of Patent claims 1, 15, and 27. The subclaims disclose further designs.

According to the invention, the pressfit contact has at least one guide area, which can be accommodated fixed in location in a guide contour of the pressfit tool, having a maximum guide length and a maximum width, the maximum guide length being a multiple of the maximum width or being essentially equal to or only slightly less than the maximum width and/or the guide area having a high stiffness in the pressfit direction (z direction) and a flexibility in the other directions (x/y directions).

The pressfit contact preferably has two (or more) shoulder elements spaced apart from one another in the axial direction, which can be accommodated fixed in location in a guide contour of the pressfit tool. The shoulder elements are arranged between a pressfit zone of the pressfit contact and a terminal part of the electronic component on the pressfit contact. Each shoulder element represents a cross-sectional expansion of the pressfit contact corresponding to the maximum width of the guide area, which each have a guide surface in contact with the guide contour of the pressfit tool.

The shoulder elements are situated at an interval from one another, which is formed by an adapter in the form of a cross-sectional constriction, whose width is less than the maximum width of the guide area. The shoulder elements can be shaped and/or dimensioned identically or differently. They can be produced in one piece or multiple pieces with the pressfit contact.

The high stiffness of the guide area in the pressfit direction (z direction) ensures the transmission of the required pressfit forces. The flexibility of the guide areas in the installed state in the x-y direction ensures the most extensive possible insensitivity to vibrations, impact stresses, and the like. The guide area has a cross-sectional constriction which ensures the flexibility for this purpose.

Each pressfit contact was preferably isolated from pressfit contacts which are linked with one another by separation.

The pressfit tool according to the invention accommodates a pressfit contact to fix it in location in at least one guide contour, which has a guide area having a maximum guide length and a maximum width, the maximum guide length being a multiple of the maximum width.

The contour length of the guide contour of the pressfit tool corresponds to at least the guide length of the pressfit contact. The shoulder element located closest to the electronic component presses against at least one stop, which is arranged transversely to the pressfit direction, of the guide contour of the pressfit tool during the press fitting procedure. The guide surfaces of the two shoulder elements press against complementary lateral surfaces of the guide contours in the pressfit direction of the pressfit tool during the press fitting procedure.

The guide contour of the pressfit tool represents a terminal cross-sectional expansion of a guide groove provided on the pressfit tool. However, the guide contour can also be arranged in an extension part, which is located terminally on the pressfit tool. The extension part can be produced in one piece with the pressfit tool. However, it can also be attached as a separate part to the pressfit tool. The guide contours are provided in inserts of the extension part, the guide contours and/or the inserts preferably being replaceable.

The production of a pressfit contact is performed according to the invention in that firstly the contours of the pressfit contacts are produced linked with one another/in a row with one another in a strip. The strip is subsequently fed to a separation station and the linked composite is separated therein at predefined separation points to form individual pressfit contacts.

In the strip, the individual contours of the pressfit contacts are connected to one another at least in the area of the guide areas and preferably also on their opposing ends.

The separation points are preferably located between two shoulder elements of a pressfit contact, so that a constriction in the form of an adapter is also formed between the shoulder elements during the separation, whereby the guide contours of the shoulder elements are not impaired by the separation procedure.

The invention is explained in greater detail hereafter on the basis of an exemplary embodiment. In the figures.

Figure 3:
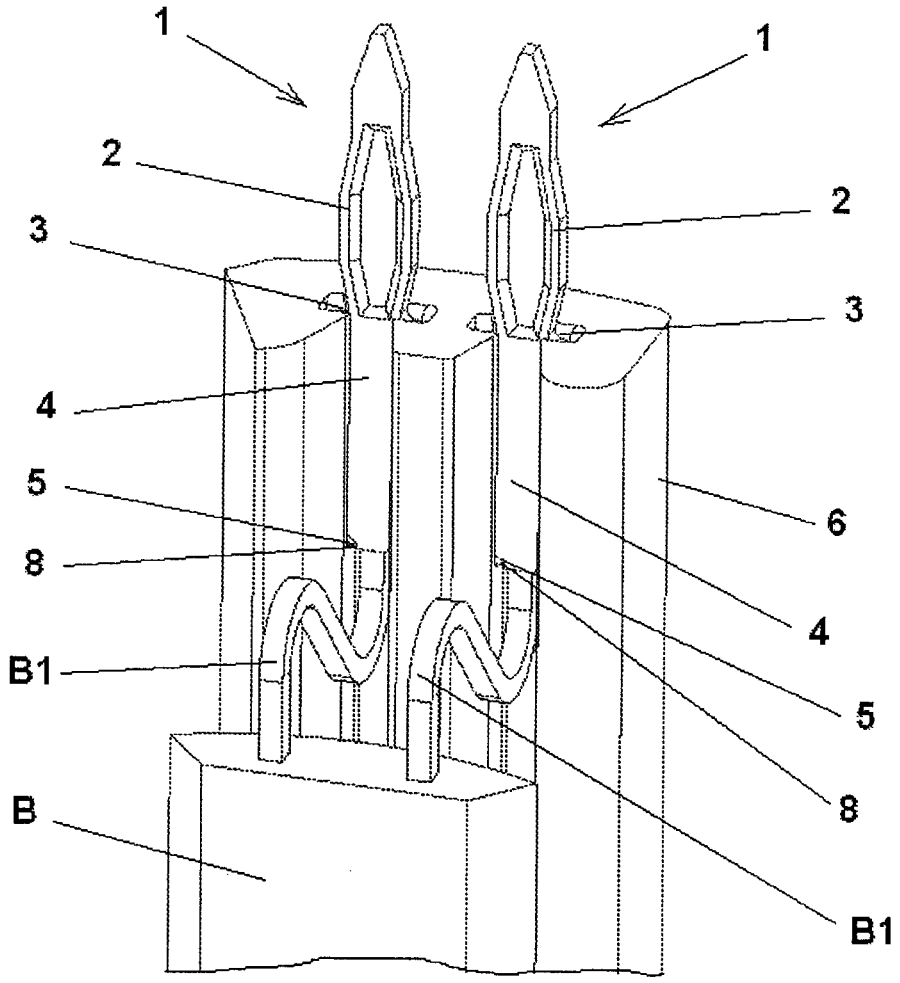
Figure 4:
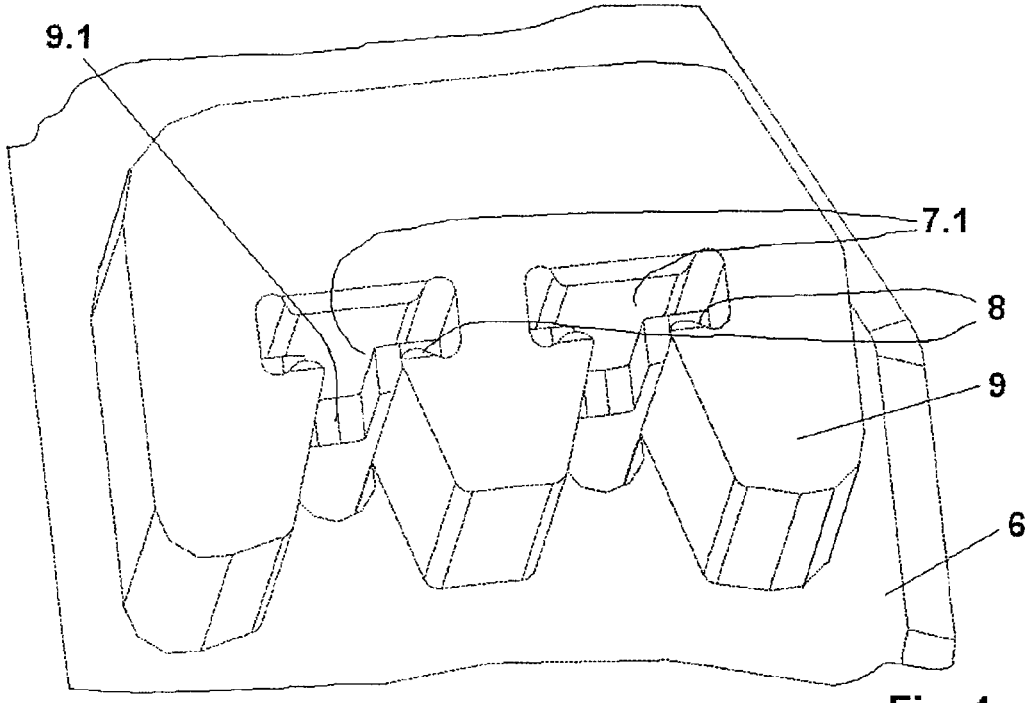
Figure 5:
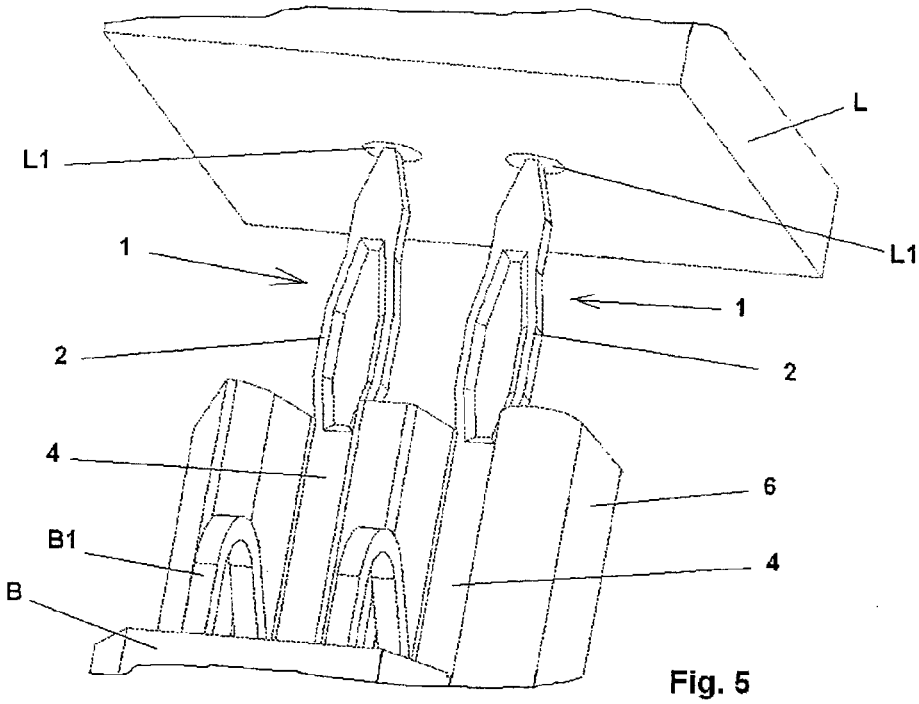
Figure 6:
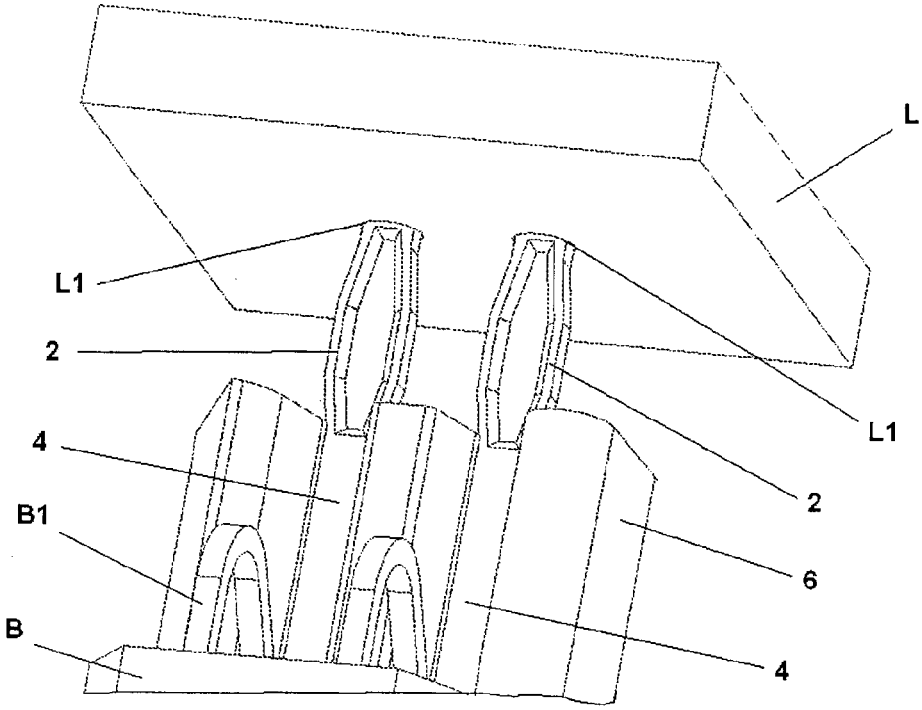
Figure 7:
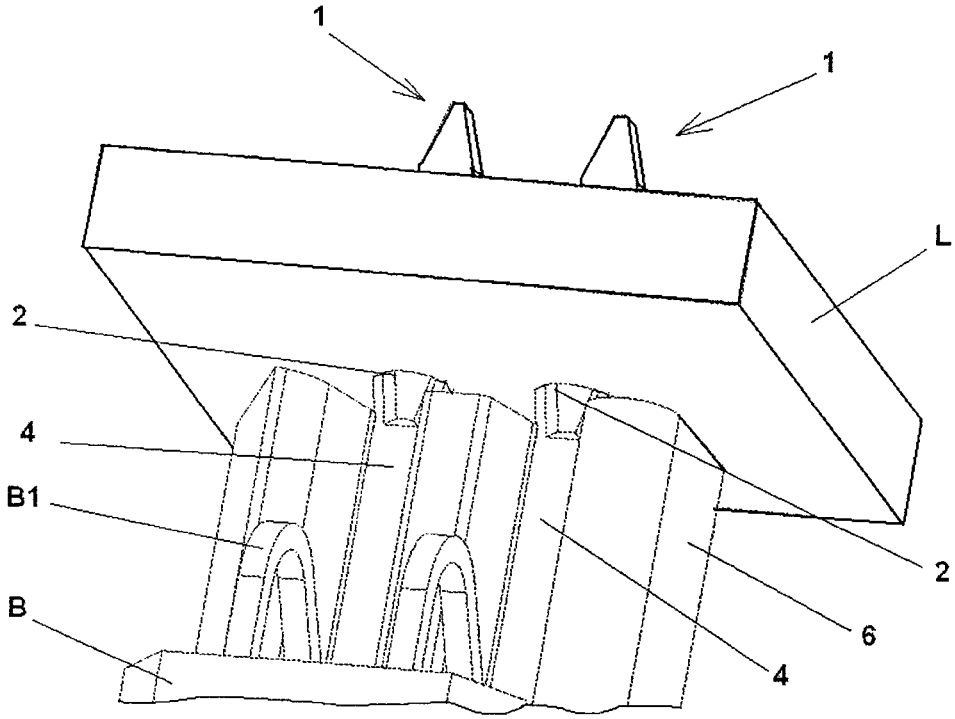

FIG. 3 shows a pressfit contact, which is accommodated by a pressfit tool, of an electronic component, FIG. 4 shows an embodiment variant of a pressfit tool, FIG. 5 shows a pressfit contact, which is accommodated by a pressfit tool, before the press fitting procedure, FIG. 6 shows pressfit contact, which are accommodated by a pressfit tool, at the beginning of the press fitting procedure, FIG. 7 shows pressfit contacts, which are accommodated by a pressfit tool, at the end of the press fitting procedure.

Figure 8:
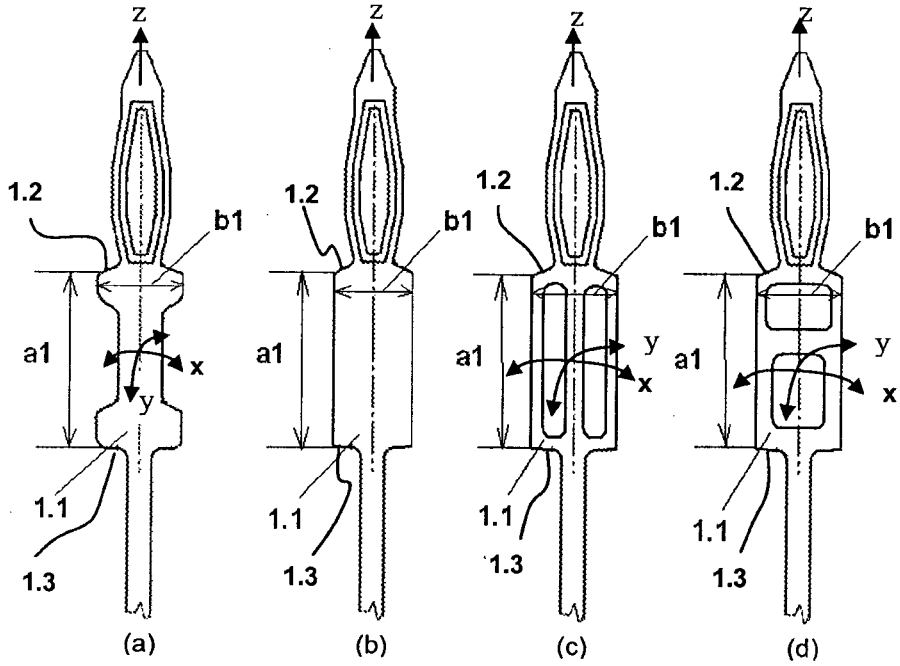
Figure 9:
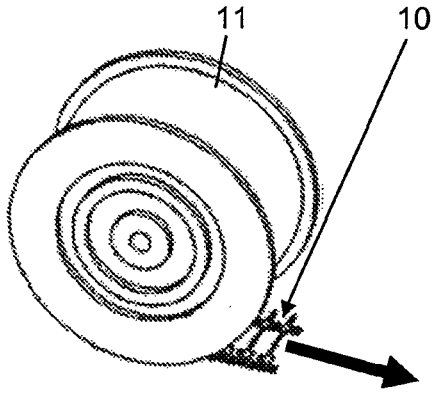
Figure 10:
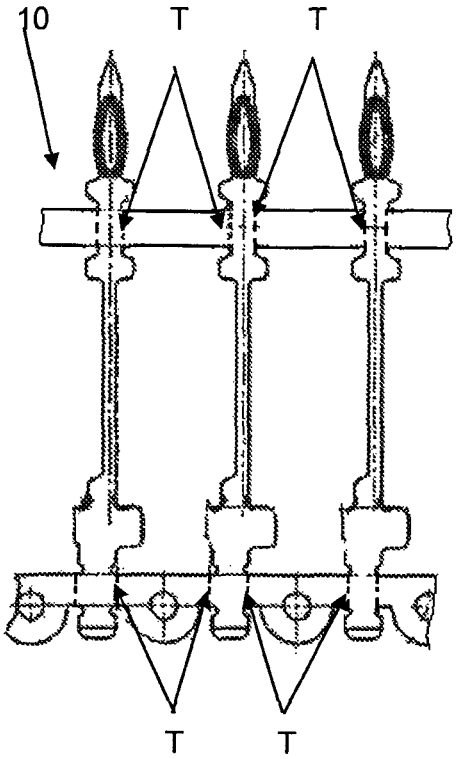
Figure 11:
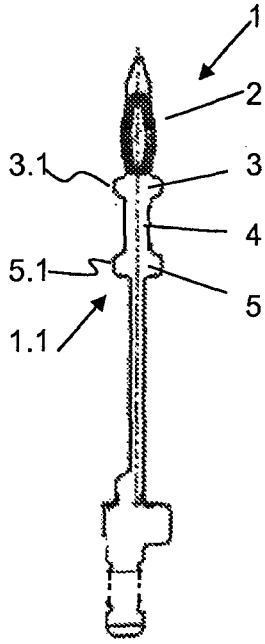

FIG. 8 shows exemplary embodiments (a) to (d) of pressfit contacts,

FIG. 9 shows a view of linked pressfit contacts, which were prefinished from a strip 10, on a roll 11, FIG. 10 shows the view of multiple contours, which are connected to one another, of pressfit contacts which were generated from a strip 10, FIG. 11 shows an isolated pressfit contact.

Figure 1:
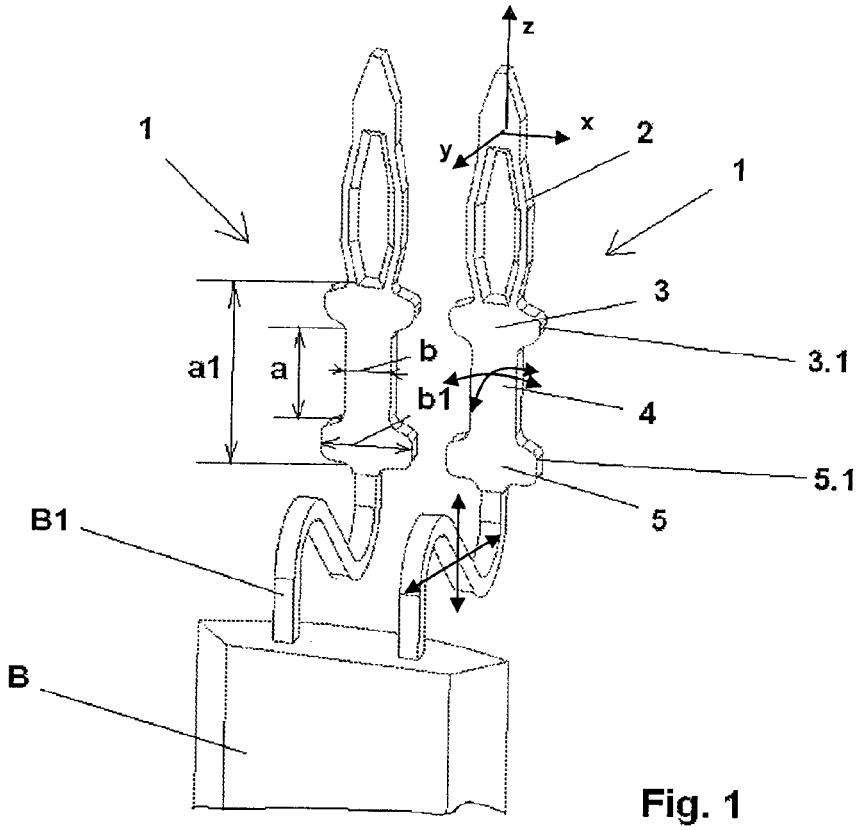
FIG. 1 shows two pressfit contacts of an electronic component.

FIG. 1 shows an electronic component B, which represents a coil, for example. The electronic component B has two terminal wire/terminal parts B1 here, on the free ends of which a pressfit contact 1 is provided in each case. Depending on the size and the composition of the electronic component B, the number of the terminal parts B1 and therefore also the pressfit contacts 1 can vary. The pressfit contacts 1 are advantageously arranged in the axial direction of the electronic component B. However, they can also be attached at an angle to the component B, as can the terminal parts B1. It is to be noted here that the direction of the press fitting procedure to be performed is to be considered the axial direction or longitudinal direction of the pressfit contact 1.

The pressfit contact 1 has a guide area 1.1, which is adjoined on the circuit board side by a pressfit zone 2 and on the component side by the terminal parts B1. The guide area 1.1 has a maximum axial guide length a1 and a maximum width b1. The maximum guide length a1 is multiple times greater than the maximum width b1 of the guide area 1.1 of the pressfit contact 1. In a preferred embodiment, the guide area 1.1 consists of two shoulder elements 3, 5, which are spaced apart from one another in the axial direction.

The first shoulder element 3 is located at an axial interval a from the second shoulder element 5, the interval a simultaneously corresponding to the length of an adapter 4 having a width b, which is reduced from the width b1. The shoulder elements 3, 5 form a maximum guide length a1 jointly with the adapter 4.

The shoulder elements 3, 5 are preferably implemented as approximately equal-sized cross-sectional expansions, corresponding to the maximum width b1, of the guide area 1.1 of the pressfit contact 1, which have a guide surface 3.1 or 5.1 in the axial direction. The shoulder elements 3, 5 can be manufactured in one piece with the pressfit contact 1 or produced in multiple pieces and are located here between the pressfit zone of the pressfit contact 1 and the terminal part B1 of the electronic component B.

However, the pressfit contact 1 can also be connected directly to the component B without a terminal part B1 interposed.

An S-shaped curved area (not shown in greater detail) is implemented between the shoulder elements 3, 5 (guide area 1.1) and the terminal part B1 of each pressfit contact 1, so that each pressfit contact 1 can be flexible in two directions (which are indicated by the double arrows), in this case in the pressfit direction (z direction) and away from the plane of the pressfit contact 1 (y direction) and perpendicularly thereto in the direction of the plane of the pressfit contact (x direction), a torsional stiffness of the pressfit contact 1 being ensured in the z direction (pressfit direction). A flexibility of the component B in relation to the circuit board equipped therewith (not shown here) is thus achieved, which ensures that it can better withstand vibrations and shocks.

In addition, a flexibility of the guide area is achieved in the x/y direction while simultaneously ensuring the required stiffness in the z direction (during the press fitting procedure) by the narrowing of the cross-section in the guide area 1.1 by the reduced width b of the adapter 4 extending between first shoulder element 3 and second shoulder element 5. The flexibility of the guide area in the x/y direction ensures a flexibility in the final product in the installed state and the stiffness in the z direction ensures the transmission of the required pressfit force.

Figure 2:
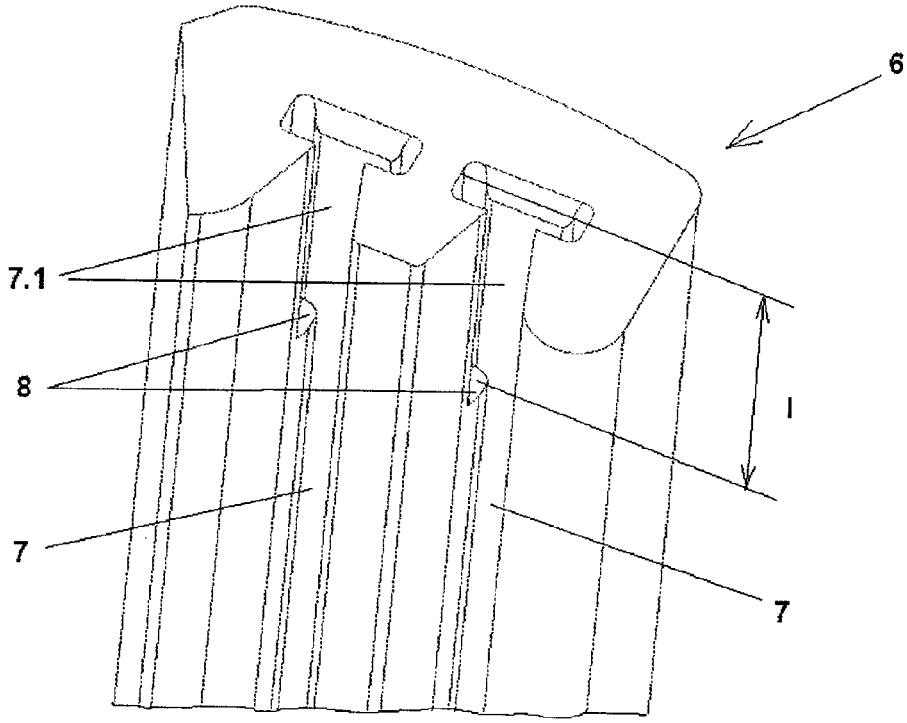
FIG. 2 shows a partial view of a pressfit tool.

FIG. 2 shows a partial view of a pressfit tool 6 like an installation comb. The pressfit tool 6 has two guide grooves 7, one guide groove 7 being provided to accommodate one pressfit contact 1 in each case. The guide grooves 7 have guide contours 7.1, which are formed by cross-sectional expansion, on the end of the pressfit tool 6 located in the direction of a circuit board L to be contacted (shown in FIGS. 5 to 7). Its contour length 1 approximately corresponds to the maximum guide length a1 of the pressfit contact 1. Stops 8 extending transversely to the axial direction each delimit the guide contours 7.1, which are open toward the end of the pressfit tool 6. The further design implementation of the pressfit tool 6 is not essential to the invention here and is therefore not shown.

In FIG. 3, the electronic component B having its pressfit contacts 1 is accommodated by the pressfit tool 6, the component-side shoulder element 5 pressing against the stops 8 of the pressfit tool 6. The shoulder element 3 adjoining the pressfit zone 2 of the pressfit contact 1 is located at the end of the pressfit tool 6 inside the guide contour 7.1. The spaced-apart shoulder elements 3, 5, which are in contact via their respective guide surfaces 3.1 or 5.1, respectively, with the guide contours 7.1, cause good positioning and location fixing of the pressfit contact 1 in the pressfit tool 6.

FIG. 4 shows a further possible embodiment of the pressfit tool 6. The pressfit tool 6 has an extension part 9 here, in which inserts 9.1 in the form of the guide contours 7.1 are located. The extension part 9 can be produced in one piece with the pressfit tool 6; however, it can also be attachable as a separate part to the pressfit tool 6. In the case of the additional extension part 9 attached to the original pressfit tool 6, simple retrofitting of pressfit tools 6, which are known per se, for pressfit contacts 1, e.g., having one shoulder element 3, to form pressfit tools 6 having two shoulder elements 3, 5 is possible. The inserts 9.1 are preferably provided as replaceable. In case of wear of the highly stressed guide contours 7.1, the old inserts 9.1 can be removed and new inserts 9.1 can be introduced instead. The possibility is thus provided of using more effective production methods for the pressfit tool 6.

FIG. 5 shows the pressfit tool 6 having the pressfit contacts 1 before the press fitting procedure in a positioning setting. The circuit board L having its contact openings L1 is located over the tips of the pressfit contacts 1, which press with the guide surfaces 3.1 or 5.1 of the two shoulder elements 3, 5 against complementary lateral surfaces of the guide contours 7.1.

In FIG. 6, the pressfit tool 6 having the pressfit contacts 1 is shown at the beginning of the press fitting procedure. The pressfit contacts 1 are located having their terminal tips in the contact openings L1 of the circuit board L.

Jointly with the shoulder element 5 pressing against the stop 8, both the adapter 4 and also the shoulder element 5 are located inside the guide contour 7.1 of the pressfit tool 6.

FIG. 7 shows the pressfit tool 6 having the pressfit contacts 1 at the end of the press fitting procedure. The circuit board L has its side facing toward the pressfit tool 6 resting thereon. The tips of the pressfit contacts 1 protrude out of the circuit board on the side of the circuit board L facing away from the pressfit tool 6, while the pressfit zones 2 of the pressfit contacts 1 are located in the contact openings L1 of the circuit board L. Both shoulder elements 3, 5 are still located, as is the adapter 4, in the guide contours 7.1 of the pressfit tool 6.

Further possible embodiments (a) to (d) of the pressfit contact 1 according to the invention are shown in FIG. 8, which do show differently implemented guide areas 1.1, but in which an approximately equal ratio of maximum guide length a1 to maximum width b1 is provided and which can be pressfit using the pressfit tool 6 according to the invention in the contact opening L1 of the circuit board L.

The fastening of the electronic component B on the circuit board L is performed as follows: To perform the press fitting procedure, the circuit board L is moved over the pressfit tool 6. The electronic component B is located having its pressfit contacts 1 in the guide contours 7.1 of the pressfit tool 6 corresponding to above-described FIG. 3.

The contact openings L1 of the circuit board L are positioned over the tips of the pressfit contacts 1. By pushing the circuit board L from above onto the pressfit contacts 1 held by the pressfit tool 6, they are pressfit into the contact openings L1 of the circuit board L.

After ending the press fitting procedure, the pressfit tool 6 is retracted, i.e., it moves downward away from the circuit board L. The electronic component B is fastened by means of its pressfit contacts 1 on the circuit board L.

It is to be noted here that the possibility also exists of moving the pressfit tool 6 in the direction of the resting circuit board L and performing the press fitting by pressure on the pressfit tool 6.

Through the second shoulder element 5, which is newly added in relation to the prior art, and which is located at an interval a, corresponding to the adapter 4, to the first shoulder element 3, a lengthened guide of the pressfit contact 1 results within the pressfit tool 6.

The dimensions of the pressfit contact 1, such as the interval a or the guide length a1, can vary depending on the field of use (but in accordance with the contour length 1 of the pressfit tool 6).

Because of the two spaced-apart shoulder elements 3, 5, which are located during the entire press fitting procedure inside the correspondingly designed guide contour 7.1 of the pressfit tool 6, a high positioning precision can be ensured during the positioning and joining procedure with the solution according to the invention. The equipping procedure can be performed easily without jamming by dimensional errors because of production.

In addition, the width b, which is provided in relation to the maximum width b1 in the form of a cross-sectional reduction, allows linking of the contacts in the production process, without the burr after the isolation (separation) of the contacts having a negative influence on the guide surfaces.

A further advantage is the flexibility of the pressfit contacts 1, which is achieved by the implementation according to the invention, during the press fitting procedure and in the installed final product.

In the exemplary embodiment shown in FIG. 1 to FIG. 7 of the drawings, the pressfit contact 1 has a guide area 1.1, whose advantages of a lengthened guide of the pressfit contact 1 within the pressfit tool 6 are achieved by two axially spaced-apart shoulder elements 3, 5, which represent a cross-sectional expansion of the guide area 1.1 having the maximum width b1. However, the guide area 1.1 can also be implemented as a single shoulder element (see FIG. 8), which has a maximum width b1 over the entire maximum guide length a1 or at least over the majority of the guide length a1. It is important that the maximum guide length a1 is also multiple times greater than the maximum width b1 here.

In the first view (a) from the left according to FIG. 8, the pressfit contact was shown having a double shoulder in the guide area according to the above-described examples. This design embodiment variant contributes to a flexibility in the final product (not shown) in the xy direction by the constriction between the two shoulders. The second variant (b) from the left shows a continuous implementation of the long guide area 1.1, which also ensures outstanding guiding during the installation. According to the third view (c) and the fourth view (d) from the left, the elongated guide area 1.1 was provided with recesses/openings (not shown) to save weight. In addition, the variants of the views (c) and (d) in FIG. 8 also result in a desired flexibility in the installed state.

It is obvious from the illustrations of FIG. 8 that each guide area 1.1 has a first shoulder 1.2 and a second shoulder 1.3, on its end opposite thereto, in the pressfit direction (z direction).

In the variants (a), (c), (d) in FIG. 8, the elongated guide area 1.1, which is provided with external constrictions or with recesses, and which has a cross-sectional narrowing between the first shoulder 1.2 and the second shoulder 1.3, is used for two functions. On the one hand, this area ensures the transmission of the required pressfit force in the z direction during the production of the connection to the circuit board (not shown here) and, on the other hand, it contributes to a flexibility in the final product in the x direction and in the y direction, which is advantageous in the event of occurring vibrations and shocks.

The variant according to FIG. 8, view (b) has a high stiffness in the z direction (pressfit direction). Because the guide area 1.1 is implemented "extensively" and therefore does not have a cross-sectional reduction, a very restricted flexibility exists in the final product.

Linking of the pressfit contacts in the production process is permitted with the novel design, in particular with the use of the "double shoulder" in the form of the two shoulder elements 3, 5, between which a constriction in the form of the adapter 4 extends (see FIG. 1), without the burr having a negative influence on the guide surfaces after the separation of the contacts.

According to FIG. 9, the contours, which are pre-stamped from the strip 10 or produced in another way (laser, waterjet cutting, etc.) of the pressfit contacts can be fed from a roll 11 (FIG. 9), for example, to a separation station and separated therein according to FIG. 10 at the provided separation points T from the strip 10 to form individual pressfit contacts 1 according to FIG. 11. The separation points T are each located between the shoulder elements 3, 5 in the direction toward the pressfit zone 2, so that therefore the adapter 4 is implemented and the guide surfaces 3.1 and 5.1 do not have a burr, whereby good guiding in the pressfit tool is ensured. The pressfit contacts 1 which are thus isolated are now bent in an S-shape and each two pressfit contacts 1 are connected to one component B (FIG. 1), which is provided for the contact with a circuit board.

In addition to the production of pressfit contacts having guide areas, whose axial guide length a1 is greater than their maximum width b1, as shown in the above-described exemplary embodiments, it is also possible that guide length and width are essentially equal or the guide length is insignificantly less than the width of the guide area, good guiding still being ensured, and this guide area can be provided with a cross-sectional reduction, which ensures a flexibility in the x/y direction and guarantees a stability in the z direction to transmit the pressfit force.

The pressfit tool used according to the invention for the press fitting of the pressfit contacts is producible cost-effectively and simply. No drive is required and the cost-effective use of these pressfit tools on nonstationary apparatuses is thus made possible.

It displays smaller dimensions than the known installation combs having sliding part, whereby the components can be moved closer to the guide axes. The entire assembly can thus be reduced in dimensions and weight.

List of Reference Signs

1 pressfit contact
1.1 guide area
1.2 first shoulder
1.3 second shoulder
2 pressfit zone
3 shoulder element
3.1 guide surface
4 adapter
5 shoulder element
5.1 guide surface
6 pressfit tool
7 guide groove
7.1 guide contour
8 stop
9extension part
9.1 inserts
10 strip
11 roll
B component
B1 terminal part
L circuit board
L1 contact opening
a distance
a1 maximum guide length
b width
b1 maximum width
l contour length
T separation points

The invention claimed is:

1. A pressfit contact for connecting an electronic component to a circuit board, said pressfit contact of the electronic component being able to be pressfitted when the pressfit contact is connected to the electronic component by a pressfit tool into a contact opening of the circuit board in a pressfit direction perpendicular to the circuit board, wherein the pressfit contact comprises at least one guide area which can be accommodated fixed in location in a guide contour of the pressfit tool, said guide area having a maximum guide length and a maximum width;

the pressfit contact includes an electrical component connection end opposite an insertion end of the pressfit contact configured to be inserted into the contact opening, the electrical connection end including a connection portion laterally displaced from a longitudinal axis of the insertion end a distance sufficient to permit the pressfit tool to pressfit the pressfit contact into the contact opening without interference from the electrical component;

said maximum guide length of the guide area being a multiple of the maximum width or being essentially equal to or only slightly less than the maximum width; and said guide area having lower flexibility in the pressfit direction than in directions orthogonal to the pressfit direction.

2. The pressfit contact according to claim 1, wherein the guide area is comprised of two shoulder elements, which are spaced apart from one another in the axial direction, and which can be accommodated fixed in location in the guide contour of the pressfit tool.

3. The pressfit contact according to claim 2, wherein each shoulder element represents a cross-sectional expansion of the guide area corresponding to the maximum width which has guide surfaces, which can be brought into contact in the axial direction with the guide contour of the pressfit tool.

4. The pressfit contact according to claim 3, wherein the shoulder elements are arranged at an interval from one another, which interval is formed by an adapter having a width which is less than the maximum width of the guide area.

5. The pressfit contact according to claim 4, wherein the guide contour of the pressfit tool has a contour length which corresponds at least to the maximum guide length of the pressfit contact.

6. The pressfit contact according to claim 2, wherein the component-side shoulder element presses against at least one stop of the guide contour of the pressfit tool during the press fitting procedure, which stop is arranged transversely to the pressfit direction.

7. The pressfit contact according to claim 2, wherein during the press fitting procedure, guide surfaces of both shoulder elements press against complementary lateral surfaces of the guide contour of the pressfit tool in the pressfit direction.

8. The pressfit contact according to claim 2, wherein the shoulder elements are shaped and dimensioned identically to each other.

9. The pressfit contact according to claim 2, wherein the shoulder elements are shaped and dimensioned differently from each other.

10. The pressfit contact according to claim 2, wherein the shoulder elements are constructed in one piece with the pressfit contact.

11. The pressfit contact according to claim 2, wherein the shoulder elements and the pressfit contact are constructed as multiple pieces.

12. The pressfit contact according to claim 11, wherein the guide area has a cross-sectional reduction which ensures flexibility in the directions other than the pressfit direction.

13. The pressfit contact according to claim 1, wherein the guide area is formed with constrictions, recesses or openings.

14. The pressfit contact according to claim 1, the pressfit contact is formed by separation of the pressfit contact from multiple pressfit contacts which are initially linked to one another.

15. A method for producing a pressfit contact according to claim 1, for connecting an electronic component having a guide area to a circuit board, said method comprising:

feeding contours of the pressfit contacts, which are produced in a row linked with one another in a strip, to a separation station, and separating the contours in said separation station at predefined separation points to form individual pressfit contacts.

16. The method according to claim 15, wherein the contours produced in the strip are connected to one another at least in the area of the guide areas and are separated in the separation station.

17. The method according to claim 15, wherein the separation points are arranged between two shoulder elements of a pressfit contact, and upon separation a constriction in the form of an adapter is formed between the shoulder elements.

18. A pressfit tool for connecting an electronic component to a circuit board by pressfitting a pressfit contact of the electronic component into a contact opening of the circuit board using said pressfit tool, wherein said pressfit tool has at least one guide contour in which a guide area of the pressfit contact having a maximum guide length and a maximum width can be received fixed in location, the maximum guide length of the guide area being a multiple of the maximum width of the guide area, or being equal to or only slightly less than the maximum width of the guide area, the pressfit tool further including a lateral gap perpendicular to a pressfit contact insertion direction, the lateral gap being configured to permit a laterally-displaced portion of the pressfit contact to pass through a side of the pressfit tool to enable use of the pressfit tool to insert the pressfit contact into a contact hole of the circuit board when the pressfit contact is connected to the electronic component.

19. The pressfit tool according to claim 18, wherein the guide area of the pressfit contact is comprised of two shoulder elements, which are spaced apart from one another in the axial direction, and which can be accommodated fixed in location in the guide contour of the pressfit tool.

20. The pressfit tool according to claim 18, wherein each shoulder element represents a cross-sectional expansion of the guide area of the pressfit contact corresponding to the maximum width, said expansion having guide surfaces which can be brought into contact in the axial direction with the guide contour of the pressfit tool.

21. The pressfit tool according to claim 18, wherein the shoulder elements are arranged at an interval from one another, which interval is formed by an adapter having a width less than the maximum width of the guide area, and wherein the maximum guide length of the pressfit contact at least corresponds to a contour length of the guide contour of the pressfit tool.

22. The pressfit tool according to claim 18, wherein during the press fitting procedure the component-side shoulder element of the pressfit contact presses against at least one stop of the guide contour of the pressfit tool, which stop is arranged transversely to the pressfit direction.

23. The pressfit tool according to claim 18, wherein during the press fitting procedure guide surfaces of both shoulder elements of the pressfit contact press in the pressfit direction against complementary lateral surfaces of the guide contour of the pressfit tool.

24. The pressfit tool according to claim 18, wherein the guide contour of the pressfit tool represents a terminal cross-sectional expansion of a guide groove provided on the pressfit tool.

25. The pressfit tool according to claim 18, wherein the guide contour of the pressfit tool is provided in a terminal extension part arranged on the pressfit tool.

26. The pressfit tool according to claim 25, wherein the extension part is constructed in one piece with the pressfit tool.

27. The pressfit tool according to claim 25, wherein the extension part is attachable as a separate part to the pressfit tool.

28. The pressfit tool according to claim 25, wherein the guide contours are provided in inserts of the extension part.

29. The pressfit tool according to claim 28, wherein the inserts or the guide contours, or both the inserts and the guide contours, are replaceable.

* * * * *